United States Patent [19]

Kobayakawa

[11] 4,140,597

[45] Feb. 20, 1979

[54] METHOD OF RECOVERING THE COMPONENT METALS FROM SINTERED METAL CARBIDES

[75] Inventor: Yoshitaka Kobayakawa, Hirakata, Japan

[73] Assignee: Toho Kinzoli Co., Ltd., Osaka, Japan

[21] Appl. No.: 846,114

[22] Filed: Oct. 27, 1977

[30] Foreign Application Priority Data

Dec. 30, 1976 [JP] Japan ..... 51-157952

[51] Int. Cl.[2] ..... C25F 5/00; C25C 1/08

[52] U.S. Cl. ..... 204/112; 204/129.1; 204/129.75; 204/140; 204/141.5; 204/146; 423/55

[58] Field of Search ..... 204/140, 141.5, 145 R, 204/146, 129.1, 129.75, 112; 423/55

[56] References Cited

U.S. PATENT DOCUMENTS 3,959,096 5/1976 Langer ..... 204/140

*Primary Examiner*—R. L. Andrews

*Attorney, Agent, or Firm*—Kane, Dalsimer, Kane, Sullivan and Kurucz

[57] ABSTRACT

The disclosure is of a simple and economical method for recovering the component metals from a sintered metal carbide. The sintered metal carbide is employed as an anode and treated by electrolysis in an acid solution. The metal carbide e.g. WC dissolves and precipitates as a metal hydroxide. At the same time the metal e.g. Co, which is a sintering binder, is electro-deposited on the surface of a cathode. The metal hydroxide may be washed, calcined and reduced in hydrogen gas to obtain a pure metal powder.

5 Claims, 1 Drawing Figure

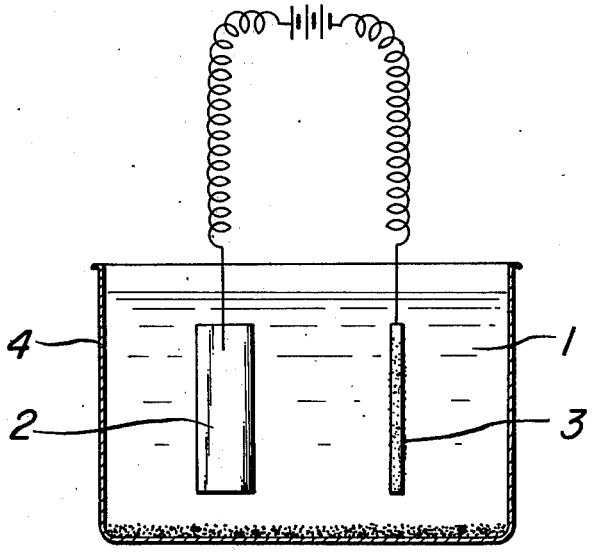
4
1
2
3

METHOD OF RECOVERING THE COMPONENT METALS FROM SINTERED METAL CARBIDES

BACKGROUND OF THE INVENTION

In a recovering method of the sintered metal carbide scrap up to this time, the sintered metal carbide scrap including, for example WC (tungsten carbide) cemented hard metals and Co is roasted at a temperature more than 1700° C., which is a higher temperature than an ordinary sintering temperature of 1400 - 1450° C., and quenched, then the cemented body becomes brittle thereby and is crushed into powder. In this method, WC and Co cannot be decomposed and recovered free of each other without using very complicate after-processes.

SUMMARY OF THE INVENTION

The invention comprises a method of recovering the component metals from a sintered metal carbide, which comprises;

treating the sintered metal carbide by electrolysis in an acid solution, whereby the metal carbide is removed as a metal hydroxide and the binding metal is electro-deposited on the surface of the cathode; and reducing the metal hydroxide to obtain the metal power.

BRIEF DESCRIPTION OF THE DRAWINGS

The accompanying FIGURE is a drawing of an electro-treating apparatus which may be used in the method of the invention.

DETAILED DESCRIPTION OF THE INVENTION

The invention of this application is a very simple and economical recovering method to be able to get each component metals (e.g. W and Co) as each component from the sintered body.

The invention of this application relates to a recovering method of each component metals from a sintered metal carbide body, in that the sintered metal carbide body is provided as an anode in acid solution (electrolyte) and treated by electrolysis, thereby the metal carbide (e.g. WC), which is used as a main component of the cemented body, is dissolved and precipitated as a metal hydroxide, and at the same time the metal (e.g. Co), which is used as a binding metal, is electro-deposited on the surface of a cathode. The obtained metal hydroxide is washed, calcined and reduced in $H_2$ gas and then pure metal is obtained.

The invention of this application is explained briefly with reference to the accompanying figure.

A sintered metal carbide scrap comprised metal carbide (e.g. WC) and binding metal (e.g. Co) is dipped into acid electrolyte 1 (preferably $HNO_3$ solution) as an anode 2, and at the same time an insoluble pole (e.g. W-bar) 3 is also dipped into the electrolyte as a cathode 3, then electrolysis is performed. During this electrolysis the WC is dissolved and becomes $H_2WO_4$, then the $H_2WO_4$ is precipitated on the bottom of vessel 4 according to the following chemical reaction:

$$WC + 6H_2O \rightarrow H_2WO_4 + CO_2 + 5H_2$$

(10 percent $HNO_3$ solution)

$$WC + 6H_2O \rightarrow WO_3.H_2O \text{ (or } WO_3.2H_2O) + CO_2 + 5H_2 \text{ (generally).}$$

The precipitated $H_2WO_4$ or $WO_3.2H_2O$ is collected, washed with water and calcined, and then the pure W powder is recovered by $H_2$-reduction.

The Co is electro-deposited on the surface of the cathode, the deposited metal Co is stripped, washed and easily recovered thereby.

DESCRIPTION OF THE PREFERRED EMBODIMENT

A sintered metal carbide scrap (WC + Co) is used as an anode. On the other hand a W-bar is used as a cathode, then the both poles are dipped in a vessel filled with (IN) $HNO_3$ solution. Electrolysis is operated on 10V, 6A, D-C.

The sintered metal body (WC+Co) used as an anode is dissolved, the $H_2WO_4$ is precipitated in the vessel and binding metal Co is deposited on the cathode. The obtained $H_2WO_4$ is washed, calcined and reduced in $H_2$ gas at a temperature of 850° C., and then fine W-powder having a quality of 99.6% is obtained. Cobalt having a quality of 99.5% is deposited on the cathode. The electric consumption to get 1 kg $H_2WO_4$ is 13 KWH.

As described above, the invention of this application is a very simple and directive recovering method of the composed metals from a sintered metal carbide scrap having very complicated components and the apparatus to carry out this invention is also very simple.

EXPLANATION OF THE DRAWING

The attached figure shows an electro-treating apparatus according to the invention of this application.

1: electrolyte
2: anode = the sintered body scrap
3: cathode = W-bar
4: vessel for electrolysis

I claim:

1. A method of recovering the component metals from a sintered metal carbide, said sintered metal carbide comprising a metal carbide in a matrix of a binding metal, which comprises;

subjecting the sintered metal carbide to electrolysis in an acid solution, using as the anode in the acid solution, the sintered metal carbide, whereby the metal carbide is dissolved and converted to a metal hydroxide which precipitates from the acid solution, and the binding metal is electro-deposited on the surface of the cathode; and subsequently reducing the metal hydroxide to obtain the corresponding metal.

2. The method of claim 1 wherein the metal hydroxide is washed and calcined before reduction.

3. The method of claim 2 wherein reducing is with hydrogen.

4. The method of claim 1 wherein the sintered metal carbide is tungsten carbide with a cobalt binder and the metal hydroxide is tungstic acid.

5. The method of claim 4 wherein the acid solution is a solution of nitric acid.

* * * * *